US005316289A

United States Patent [19]

Matsuo

[11] Patent Number: 5,316,289

[45] Date of Patent: May 31, 1994

[54] SHEET CONVEYING APPARATUS WITH STOP TIMING DELAY OF UPSTREAM CONVEYING MOTOR

[75] Inventor: Shimpei Matsuo, Tokyo, Japan

[73] Assignee: Canon Kabushiki Kaisha, Tokyo, Japan

[21] Appl. No.: 87,857

[22] Filed: Jul. 9, 1993

[30] Foreign Application Priority Data

Jul. 15, 1992 [JP] Japan ..... 4-188185

[51] Int. Cl.[5] ..... B65H 7/04

[52] U.S. Cl. ..... 271/258; 271/263

[58] Field of Search ..... 271/9, 258, 259, 263

[56] References Cited

U.S. PATENT DOCUMENTS 4,121,820 10/1978 Förster ..... 271/163 X 4,384,712 5/1983 Miyamoto ..... 271/263 X

*Primary Examiner*—Richard A. Schacher

*Attorney, Agent, or Firm*—Fitzpatrick, Cella, Harper & Scinto

[57] ABSTRACT

A sheet conveying apparatus includes: a first conveying unit driven by a first motor; a second conveying unit which is driven by a second motor and situated downstream from the first conveying unit; abnormality detecting unit for detecting an abnormality in the apparatus; a clock unit for counting a predetermined time following the timing of detection of an abnormality by the abnormality detecting unit; and control unit for separately stopping the motors when the abnormality detecting unit has detected an abnormality. The control unit stops the second motor in response to the output from the abnormality detecting unit and stops the first motor a predetermined time there-after in response to the output from the clock unit.

6 Claims, 7 Drawing Sheets

TIMING CHART FOR STOPPING MOTOR ON JAM DETECTION

TIMING CHART FOR STOPPING MOTOR ON JAM DETECTION

TIMING CHART FOR STOPPING MOTOR ON JAM DETECTION

SHEET CONVEYING APPARATUS WITH STOP TIMING DELAY OF UPSTREAM CONVEYING MOTOR

BACKGROUND OF THE INVENTION

1. Field of the Invention

The present invention relates to a sheet conveying apparatus comprising a plurality of drive motors for conveying sheets. The sheet conveying apparatus is suitable for use in laser beam printers, copying machines, etc.

2. Description of the Related Art

Image forming apparatus, such as a laser beam printer, which performs printing by transferring a toner image formed on the drum to a predetermined area of a recording sheet, generally comprises two motors provided respectively for driving the printing section for continuously forming images and driving the sheet feeding section for supplying sheets to the printing section. These separate motors facilitate efficient print position control including timing control of electrostatic initialization of the printing section, sheet pick-up from the sheet stacker in the sheet feeding section, and re-feeding by the sheet feeding section in accordance with the image forming timing of the printing section. Such print position control can be performed simply by controlling the operations of the individual motors.

However, because the separate drive systems for the sheet feeding section and the printing section have different moments of inertia and cause different drive losses, they require different lengths of time to stop in response to a motor stop signal. In many image forming apparatuses, the printing section, situated downstream of the sheet feeding section, has a larger moment of inertia and therefore requires a longer time to stop than the sheet feeding section. If an emergency stop motor signal is output in such an apparatus due to, for example, sheet jamming, while a sheet is being transferred from the sheet feeding section to the printing section, the sheet is held tense between the two sections. That is because the printing section forcibly pulls the sheet from the sheet feeding section. In such cases, the drive systems, the drum and the like receive excessively large loads, thereby reducing the durability and service life of the apparatus.

SUMMARY OF THE INVENTION

Accordingly, an object of the present invention is to provide a sheet conveying apparatus which delays the stop timing of the upstream conveyor motor so that the upstream conveyor motor will stop subsequent to the downstream conveyor motor in response to a stop signal.

In accordance with one aspect of the invention, there is provided a sheet conveying apparatus comprising, first conveying means for conveying a sheet in a sheet feeding section, said first conveying means including a first motor drive system; second conveying means for conveying a sheet through a printing section, said second conveying means including a second motor drive system, wherein said second motor drive system is situated downstream of said first motor drive system, said second motor drive system has a moment of inertia different from that of said first motor drive system, and said second motor drive system requires a longer time to stop than said first motor drive system; detecting means for detecting passage of a sheet through said second conveying means and outputting a detection signal; and control means for identifying a jam and stopping said first and second motor drive systems when no detection signal is received after a predetermined time from when said second motor drive system has begun to convey a sheet, wherein said control means delays the stoppage of said first motor drive system until after stoppage of said second motor drive system.

In another aspect of the invention there is provided a sheet conveying apparatus comprising, first conveying means driven by a first motor; second conveying means driven by a second motor, said second conveying means being situated downstream of said first conveying means; abnormality detecting means for detecting an abnormality in said sheet conveying apparatus; clock means for counting a predetermined time following detection of an abnormality by said abnormality detecting means; and control means for, when said abnormality detecting means has detected an abnormality, immediately stopping said second motor in response to the output from said abnormality detecting means and stopping said first motor in response to the counting of the predetermined time by said clock means.

Further objects, features and advantages of the present invention will become apparent from the following description of the preferred embodiments with reference to the attached drawings.

DESCRIPTION OF THE PREFERRED EMBODIMENTS

The preferred embodiments of the present invention will be described hereinafter with reference to accompanying drawings.

Figure 2:
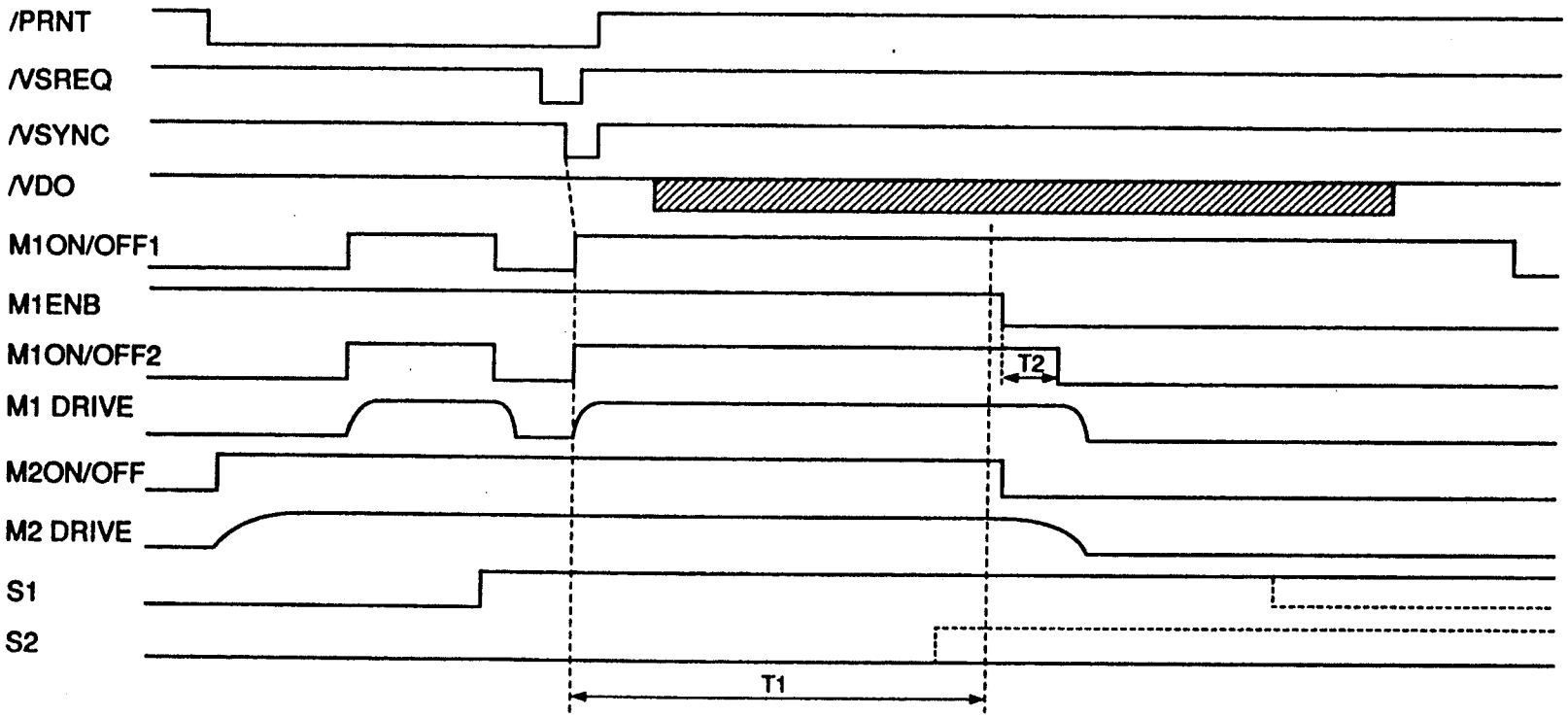
FIG. 2 is a timing chart of the motor stopping operation performed by the printer apparatus shown in FIG. 1 when sheet jam is detected.
Figure 3:
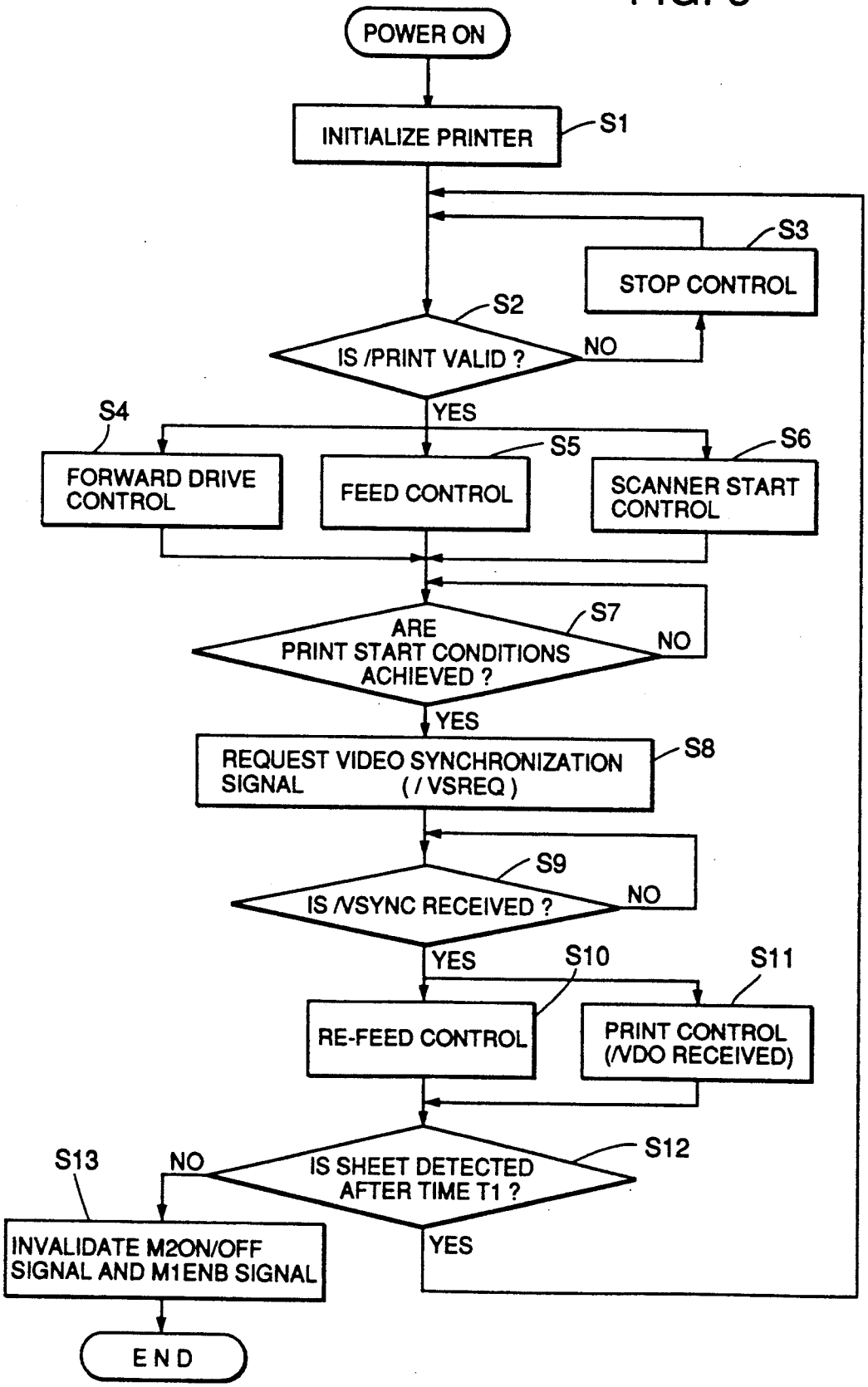
FIG. 3 is a flowchart of the operation of the printer apparatus shown in FIG. 1.

The first embodiment of the present invention will be described with reference to FIGS. 1 to 3.

Figure 1:
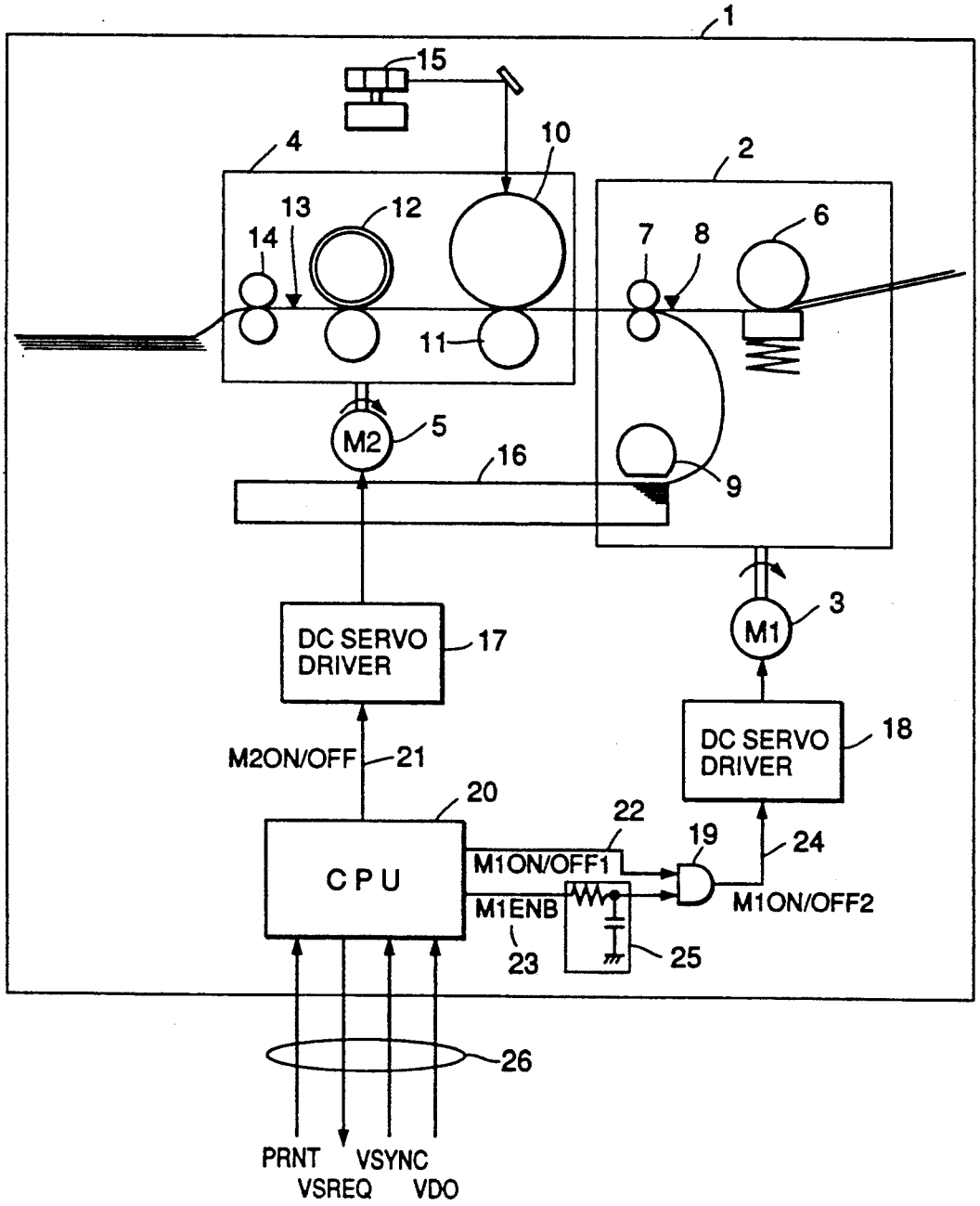
FIG. 1 illustrates the construction of a laser beam printer employing a first embodiment of the sheet conveying apparatus of the preset invention.

Referring to FIG. 1, a laser beam printer engine 1 receives image signals and control signals developed into dot data from an image signal generating section (not shown) via a video interface 26, that is, a communication bus, and accordingly performs printing on a recording medium.

A CPU 20 controls the entire printer engine 1.

A sheet feeding section 2 is driven by a DC servomotor 3. Each of pick-up rollers 6 and 9 is rotated substantially 360° at a time by mechanical means (not shown) so as to selectively feed the uppermost sheet into the corresponding sheet feeding opening when a /PRINT signal from the video interface 26 becomes valid. Register rollers 7 hold the recording sheet at a predetermined position when the DC servomotor 3 is stopped a predetermined length of time after a feed sheet sensor 8 has sensed the recording sheet fed by either one of the pick-up rollers 6, 9. When the recording sheet is thus registered, the CPU 20 outputs a /VSREQ signal to the image signal generating section via the video interface 26.

A printing section 4 is driven by a DC servomotor 5. The printing section 4 comprises a photosensitive drum 10, a transfer roller 11, a laser scanner 15, a thermo-fixer unit 12, and eject rollers 14. In accordance with a known electrophotographic process, the laser scanner 15 forms an image on the photosensitive drum 10; the image is transferred to a recording sheet by the transfer roller 11; the image transferred is fixed by the thermo-fixer unit 12; and then the recording sheet is ejected from the printing section 4 by eject rollers 14.

DC servomotor drivers 17 and 18 are connected to the DC servomotors 5 and 3, respectively, and servo-control the respective DC servomotors 5, 3 in accordance with signals from an external source, e.g., the CPU 20. The CPU 20 outputs, from an output port, an M20N/OFF signal 21 to the DC servomotor driver 17 so as to control the operation of the DC servomotor 5. The CPU 20 sends an MlON/OFF1 signal 22 for controlling the operation of the DC servomotor 3 to one of the input ports of a motor operation enabling gate 19, and an MLENB signal 23 for enabling the MLON-/OFFI signal 22 to the other input port of the motor operation enabling gate 19 via a CR circuit 25.

An ejection sheet sensor 13 is connected to the CPU 20. If the ejection sheet sensor 13 does not detect a sheet in a predetermined time T1 after the re-feeding timing determined by a /VSYNC signal, the CPU 20 determines that the recording sheet has been jammed, and then invalidates the M2ON/OFF signal 21 and the MLENB signal 23.

Sensor 13 may serve as an abnormality detecting means for detecting an abnormality in sheet conveyance, such as, for example, a paper jam. Of course, any other known means for detecting jams and other sheet conveying abnormalities may be used in conjunction with this invention.

The motor operation enabling gate 19 comprises a CMOS-AND gate having two inputs. The motor operation enabling gate 19 uses a threshold of 2.5 V to input a saw tooth waveform which the CR circuit has formed by integrating the MLENB signal 23, thus delaying the input of the signal by a predetermined time T2. Then, the motor operation enabling gate 19 outputs to the DC servomotor driver 18 an M1ON/OFF2 signal which is the AND (logic product) of the saw tooth waveform and the M1ON/OFF1 signal.

The operation of the above-described apparatus will be described with reference to the timing chart and flowchart shown in FIGS. 2 and 3.

When the power source is switched on, the printer is initialized in Step S1. After the image signal generating section outputs the PRINT signal to the CPU 20, the CPU 20 determines in Step S2 whether the PRINT signal is valid. If it is not valid, the motor stop control is performed in Step S3, and the process goes back to Step S2 to determined again whether the PRINT signal is valid. If the CPU 20 determines the PRINT signal is valid, the CPU 20 outputs to the DC servomotor driver 17 the M2ON/OFF signal 21 for controlling the operation of the DC servomotor 5 so as to drive the DC servomotor 5 forward in Step S4 (the forward drive control). Further, the CPU 20 outputs to the motor operation enabling gate 19 the M1ON/OFF1 signal 22 for controlling the operation of the DC servomotor 3 and, simultaneously, the MIENB signal 23 to the motor operation enabling gate 19 via the CR circuit. Then, the motor operation enabling gate 19 outputs the M1ON-/OFF2 signal 24 to the DC servomotor driver 18 which then controls the DC servomotor 3 so as to rotate the pick-up roller 3 or 9 by 360°, thus selectively feeding the uppermost sheet into the sheet feed opening in Step S5 (the feed control). In step SB, when the feed sheet sensor 8 senses a recording sheet, the DC servomotor 3 is stopped so that the register rollers 7 hold the recording sheet at a predetermined position. In Step S6, the laser scanner 15 is started when the PRINT signal becomes valid.

The CPU 20 determines in Step S7 whether the forward drive control, the feed control and the scanner start control in Steps S4, SS and S6 have been completed, that is, whether the print start conditions have been achieved. If the print start conditions have been achieved, the process proceeds to Step S8, where the CPU 20 outputs a VSREQ signal for requesting an image synchronization signal VSYNC to the image signal generating section via the video interface 26. When the image signal generating section receives the VSREQ signal, the section outputs a VSYNC signal and a video signal VDO to the CPU 20 via the video interface 26. When the CPU 20 receives the VSYNC signal in Step S9, the DC servomotor 3 is restarted so that the recording sheet will correspond to the position of the image formed on the photosensitive drum 10 in Step S10 (the re-feed control). Simultaneously, the printing section 4 is driven by the DC servomotor 5 in Step S11, thus performing the electrophotographic process, in which the image formed by the laser scanner 15 on the photosensitive drum 10 is transferred to the recording sheet (the print control). If the ejection sheet sensor 13 detects the recording sheet in a predetermined time T1 after the re-feed timing in Step S12, the process returns to Step S2. If the ejection sheet sensor 13 does not detect the recording sheet in the predetermined time T1, the CPU 20 determines that the recording sheet has been jammed, and invalidates the M2ON/-OFF signal 21 and the MLENB signal 23 in Step S13. Although the M2ON/OFF signal 21 and the MLENB signal 23 are simultaneously invalidated (shifted to the off level) in Step S13, the off timing of the M1ON-/OFF2 signal 24 for controlling the DC servomotor 3 is delayed by the predetermined time T2 from the off timing of the MLENB signal 23.

Because the timing for switching off the DC servomotor 3 of the sheet feeding section 2 is delayed from the timing for switching off the DC servomotor 5 of the printing section 4 after a sheet jam occurs, the stop timing of the DC servomotor 3 can be delayed relative to the stop timing of the DC servomotor 5 even though the DC servomotor 3 has a smaller moment of inertia than the DC servomotor 5, that is, even though the DC servomotor 3 requires a shorter time to stop than the DC servomotor 5.

Figure 4:
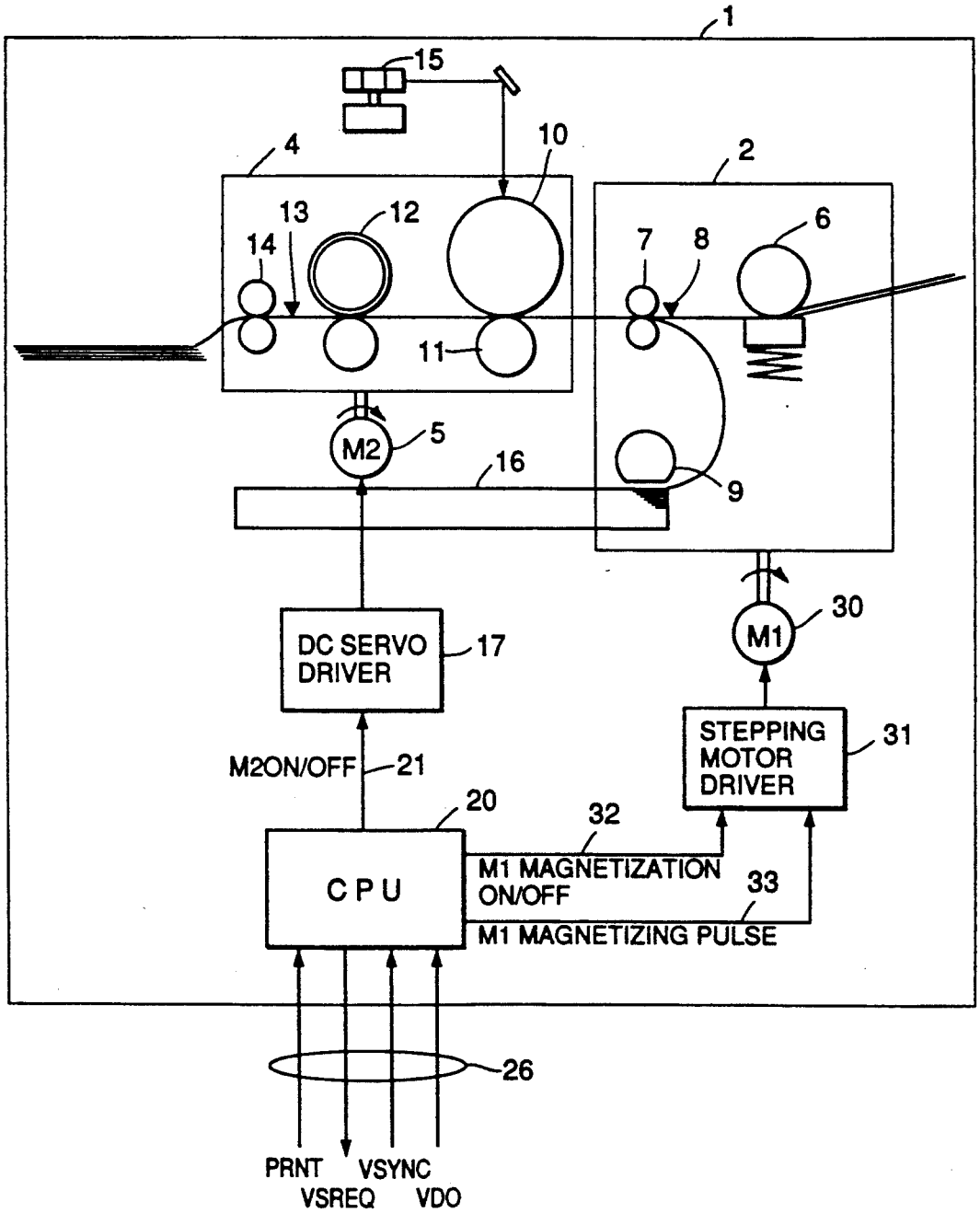
FIG. 4 illustrates the construction of a laser beam printer employing a second embodiment of the sheet conveying apparatus of the preset invention.
Figure 5:
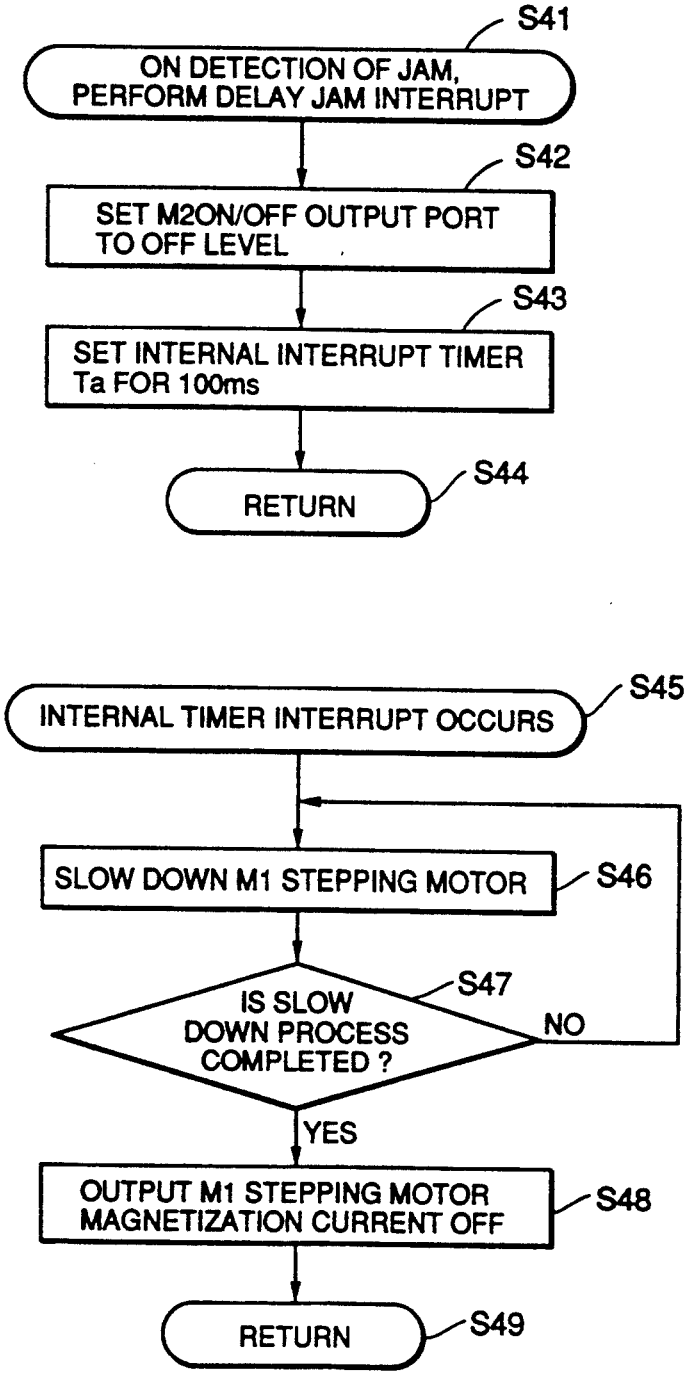
FIG. 5 is a flowchart of the operation performed by the printer apparatus shown in FIG. 4 when a sheet jam is detected.
Figure 6:
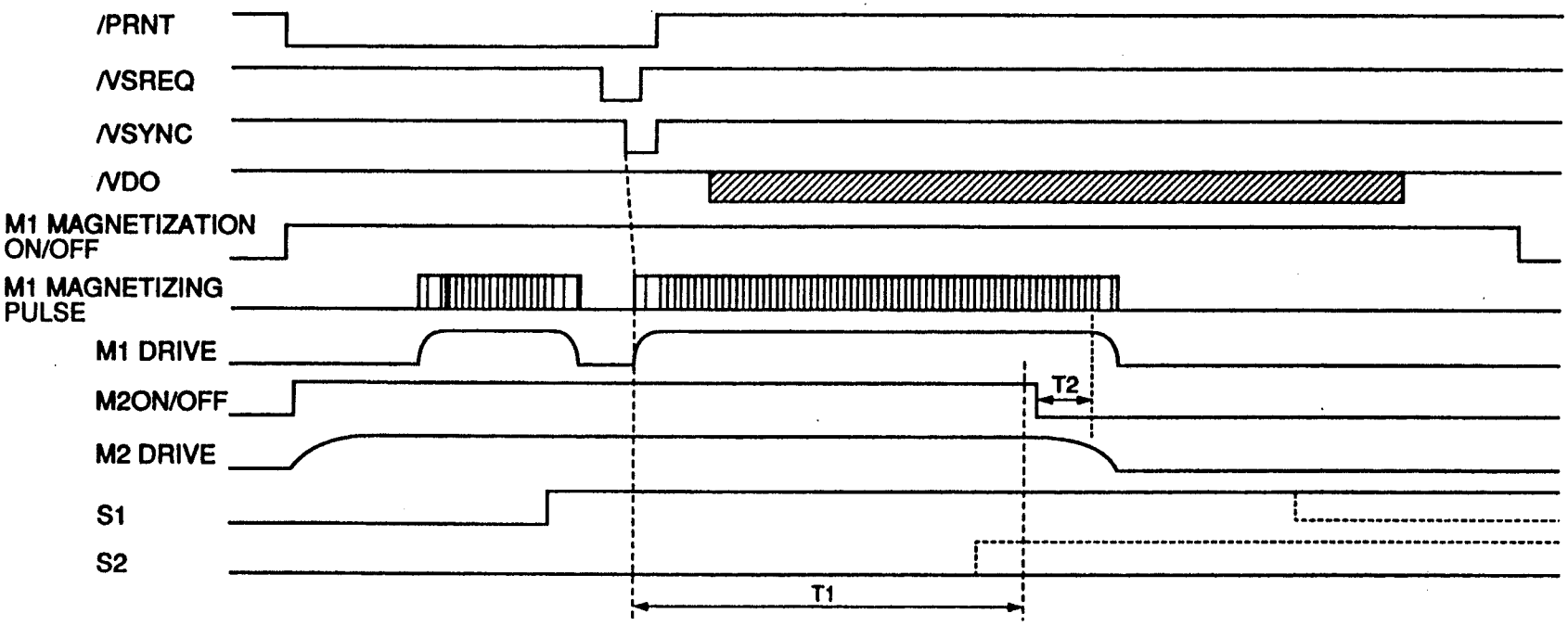
FIG. 6 is a timing chart of the operation performed by the printer apparatus shown in FIG. 4 when a sheet jam is detected.

The second embodiment of the present invention will be described with reference to FIGS. 4 to 6. Components comparable to those in the first embodiment are denoted by the same numerals in the figures and will not be described again.

Whereas the first embodiment employs hardware, including the external CR circuit 25, to delay the stop timing of the motor of the sheet feeding section 2 relative to the stop timing of the motor of the printing section 4, the second embodiment employs software provided in the printer engine controlling CPU 20 to achieve such a timing delay.

First, the hardware construction of the second embodiment will be described with reference to FIG. 4. A stepping motor 30 is employed in place of the DC servomotor 3 in the first embodiment to drive sheet feeding section 2. A stepping motor driver 31 drives the stepping motor 30 in accordance with an MI magnetization ONIOFF signal 32 and an MI magnetizing pulse signal 33 input to the stepping motor driver 31.

The operation performed by the sheet conveying apparatus of the second embodiment when a sheet jam is detected will be described with reference to FIGS. 5 and 6. This operation omits the processing performed in Steps S12 and S13 in the first embodiment because the second embodiment performs sheet jam detection by interrupt processing.

When the CPU 20 detects a sheet jam in cooperation with the ejection sheet sensor 13, the CPU 20 performs delay jam interrupt in Step S41. By the delay jam interrupt, the CPU 20 sets the M2ON/OFF signal output port to the off level in Step S42, and sets the interrupt timer Ta for 100 milliseconds in Step S43. The CPU 20 returns to the original operation and waits for the timer interrupt in Step S44.

When the timer interrupt occurs after 100 ms in Step S45, the CPU 20 slows down the stepping motor 30 in Step S46. In Step S47, it is determined whether the slowdown process is completed and, if yes, the CPU 20 turns off the stepping motor magnetization current in Step S48. The operation is thus completed in Step S49.

As described above, the second embodiment delays the stop timing of the motor of the sheet feeding section relative to the stop timing of the motor of the printing section by using the software clock (serving as a clock means) provided in the CPU as the emergency stop delay clock.

Because the second embodiment employs software instead of hardware to achieve the stop timing delay, it does not increase the production costs.

Figure 7:
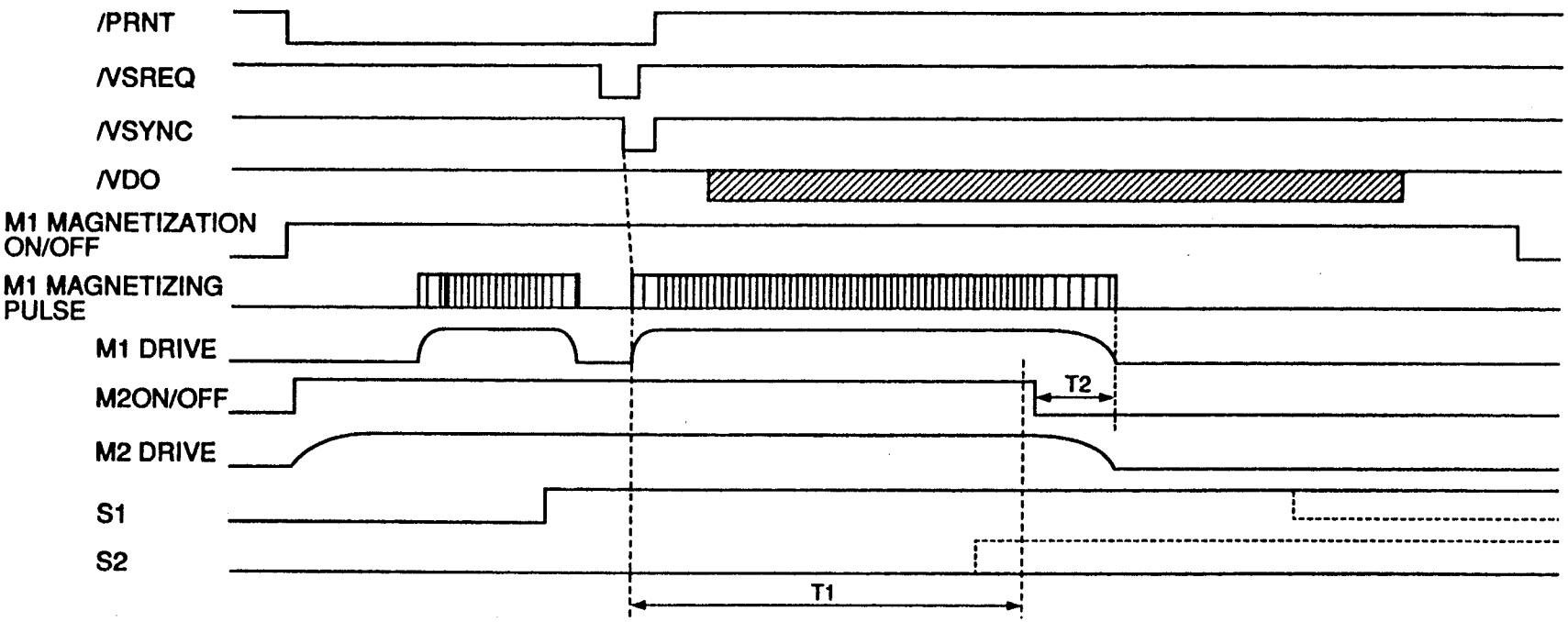
FIG. 7 is a modification of the timing chart shown in FIG. 6.

Although the first and second embodiments employ clock means to delay the timing of stopping the motor of the sheet feeding section, the motor stopping timing delay can be achieved by other means, e.g., controlling the magnetizing pulses so as to gradually slow down the stepping motor, according to the present invention, and as illustrated in FIG. 7. Such magnetizing pulse slowdown control of the stepping motor can be achieved by the hardware construction according to the second embodiment.

To summarize, the present invention provides various sheet conveying apparatuses which delay the stop timing of the motor of the upstream-situated conveying means relative to the stop timing of the motor of the downstream-situated conveying means by employing clocking means or the like to control the upstream conveying means.

Therefore, the present invention is applicable to various types of sheet conveying apparatuses employing a plurality of drive motors. For example, the present invention can be applied to sheet feed control between the printer and an optional sheet feeder.

As described above, a sheet conveying apparatus according to the present invention employs clock means or the like to control the motor driving the upstream conveying means so as to delay the stop timing of the upstream conveying means relative to the downstream conveying means.

The sheet conveying apparatus of the present invention is able to stop the motor of the upstream conveying means later than the motor of the downstream conveying means, even though the upstream conveying means requires a shorter time to stop than does the downstream conveying means, due to the different moments of inertia and the driving losses for the two motors.

Therefore, even if a stop signal is suddenly generated to stop the upstream and downstream conveying means while a recording sheet is held both by the upstream conveying means and the downstream conveying means, the sheet will not be held tense therebetween. The downstream conveying means will therefore not forcibly pull the sheet from the upstream conveying means, thus preventing the drive means and drums from receiving excessively large loads. The present invention achieves substantially long service life and optimal durability of the conveying means.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A sheet conveying apparatus comprising:

first conveying means for conveying a sheet in a sheet feeding section, said first conveying means including a first motor drive system;

second conveying means for conveying a sheet through a printing section, said second conveying means including a second motor drive system, wherein said second motor drive system is situated downstream of said first motor drive system, said second motor drive system has a moment of inertia different from that of said first motor drive system, and said second motor drive system requires a longer time to stop than said first motor drive system;

detecting means for detecting passage of a sheet through said second conveying means and outputting a detection signal; and control means for identifying a jam and stopping said first and second motor drive systems when no detection signal is received after a predetermined time from when said second motor drive system has begun to convey a sheet, wherein said control means delays the stoppage of said first motor drive system until after stoppage of said second motor drive system.

2. A sheet conveying apparatus according to claim 1, wherein said detecting means comprises a sheet sensor for determining whether a sheet has been ejected from said second conveying means.

3. A sheet conveying apparatus according to claim 1, wherein, when determining that said detection means has not outputted a detection signal after said predetermined time, said control means outputs a first signal for immediately stopping said second motor drive system and outputs a second signal for stopping said first motor drive system after a predetermined time.

4. A sheet conveying apparatus according to claim 2, wherein said control means determines whether said sheet sensor has outputted a detection signal after said predetermined time has elapsed.

5. A sheet conveying apparatus according to claim 1, further comprising a timer for delaying the stop timing of said first motor drive system so that said first motor drive system will stop a predetermined time after said control means determines that said detecting means has not outputted a detection signal.

6. A sheet conveying apparatus comprising:

first conveying means driven by a first motor;

second conveying means driven by a second motor, said second conveying means being situated downstream of said first conveying means;

abnormality detecting means for detecting an abnormality in said sheet conveying apparatus;

clock means for counting a predetermined time following detection of an abnormality by said abnormality detecting means; and control means for, when said abnormality detecting means has detected an abnormality, immediately stopping said second motor in response to the output from said abnormality detecting means and stopping said first motor in response to the counting of the predetermined time by said clock means.

* * * * *

UNITED STATES PATENT AND TRADEMARK OFFICE

CERTIFICATE OF CORRECTION

PATENT NO. : 5,316,289
DATED : May 31, 1994
INVENTOR(S) : SHIMPEI MATSUO

It is certified that error appears in the above-indentified patent and that said Letters Patent is hereby corrected as shown below:

Column 2,
line 33, "preset" should read --present--; and
line 41, "preset" should read --present--.

Column 3,
line 27, "M2ON/OFF" should read --M2ON/OFF--;
line 32, "MLENB" should read --M1ENB--, and
"MLON-" should read --M1ON--;
line 41, "MLENB" should read --M1ENB--;
line 52, "MLENB" should read --M1ENB--; AND
line 67, "determined" should read --determine--.

Column 4,
line 15, "step SB," should read --step S5,--;
line 23, "SS" should read --S5--;
line 49, "MLENB" should read --M1ENB--;
line 50, "MLENB" should read --M1ENB--; and
line 55, "MLENB" should read --M1ENB--.

Column 5,
line 15, "MI" should read --M1--; and
line 16, "ONIOFF" should read --ON/OFF--.

Signed and Sealed this

Twenty-fifth Day of October, 1994

*Attest:*

*Attesting Officer*

Bruce Lehman

BRUCE LEHMAN

*Commissioner of Patents and Trademarks*